United States Patent [19]

Ausnit

[11] Patent Number: 4,878,763

[45] Date of Patent: Nov. 7, 1989

[54] DOUBLE HINGE ZIPPER CONSTRUCTION

[75] Inventor: Steven Ausnit, New York, N.Y.

[73] Assignee: Minigrip, Inc., Orangeburg, N.Y.

[21] Appl. No.: 277,979

[22] Filed: Nov. 30, 1988

[51] Int. Cl.[4] ..... B65D 33/16

[52] U.S. Cl. ..... 383/65; 24/587; 24/576

[58] Field of Search ..... 383/63, 65; 24/587, 24/576, 90 HA; 493/214, 215

[56] References Cited

U.S. PATENT DOCUMENTS

| | | | |
|---|---|---|---|
| 2,978,769 | 4/1961 | Harrah | 383/65 X |
| 3,347,298 | 10/1967 | Ausnit et al. | 383/65 |
| 3,991,801 | 11/1976 | Ausnit | 383/65 X |
| 4,268,938 | 5/1981 | Walchli | 383/63 X |
| 4,682,366 | 7/1987 | Ausnit et al. | 383/65 |
| 4,817,188 | 3/1989 | Van Erden | 383/63 |

*Primary Examiner*—Stephen Marcus
*Assistant Examiner*—Jes F. Pascua
*Attorney, Agent, or Firm*—Hill, Van Santen, Steadman & Simpson

[57] ABSTRACT

An improved reclosable bag structure formed out of a plastic film or laminations thereof with front and back wall panels attached along their bottom and along their side edges and having fastener strips along the inner surfaces of the panels at the bag top with the strips secured thereto and one strip having a web element which is secured at its lower edge below the center line of the first strip and the other strip having a web element which is secured to the top of the strip with said web elements bonded along their faces to the inner surfaces of the panels at the top of the bag so that forces against the bag walls cause the strips to tilt and resist separation with said forces being applied in a shear mode rather than a peel mode.

17 Claims, 1 Drawing Sheet

DOUBLE HINGE ZIPPER CONSTRUCTION

BACKGROUND OF THE INVENTION

The present invention relates to improvements in plastic film bags with pressure closable and reopenable rib and groove profile fasteners at the top.

In the development of thin plastic film bags, an objective to be served is to provide a bag which has pressure closable and reopenable continuous rib and groove fastener elements at the top. Such fastener elements must securely close the bag and resist accidental opening due to forces on the side walls of the bag which occur during stacking, handling and merchandising. In order to reduce the cost of the bag, the fastener profiles are made as lightweight as possible without jeopardizing the facility of the fasteners to hold the bag closed. The ability of the fastener to remain closed can be augmented by design of a fastener but also by design of the bag structure in relation to the fastener structure. Coaction between the bag wall panels and the fastener strips can be attained by structural design so that stresses and pulls on the bag wall, such as occur inadvertently, do not pull apart the fastener strips to open the rib and groove profile fastener elements.

Efforts which have been made to provide a bag with a reclosable rib and groove fastener that withstands shocks and opening stresses have largely been directed at improving the form of the fastener, and in some instances it has been recognized that with a given fastener, the manner in which the forces are transmitted to the fastener is significant in improving the closure strength and integrity of the fastener strips. For example, an early development wherein a hinge action is sought so that the side wall of a bag can pivot outwardly without directly applying a stress to the fastener is shown and described in U.S. Pat. No. 3,054,434, Ausnit et al, entitled "Bag Closure". In this patent, a hinge arrangement is provided wherein the fastener strips are located at the top of the bag projecting fully above the bag walls.

Another form of structure provided to improve the closure strength is shown and describe in U.S. Pat. No. 3,347,298, Ausnit et al, entitled "Flexible Fastener With Unidirectional Opening Wherein Strengthening Filling Material is Utilized With the Fastener".

Another arrangement wherein some hinge relationship occurs between the side walls and the fastener is illustrated in U.S. Pat. No. 4,682,366, Ausnit et al, entitled "Attachment of Plastic Zipper to Incompatible Bag Wall Web", although the primary purpose of the disclosure is for other objectives.

An arrangement illustrating the use of a separate fastener attached within the walls of the bag is illustrated in co-pending application, Ser. No. 164,970, Van Erden, entitled "Bag With Separate Attachment Zipper and Method of Making", filed Mar. 7, 1988.

An object of the invention is to provide an improved bag structure which has a greater resistance to opening wherein the bag is constructed with separate fastener strips attached to the inner wall surface of the panels.

A further object of the present invention is to provide an improved bag construction and a method of making wherein the bag has a reclosable fastener at the top and can withstand pulls and stresses caused by the contents acting on the side walls of the bag without accidental opening of the bag.

A further object of the invention is to provide an improved structure and method of making the structure wherein a flexible bag is provided with a rib and groove type of reopenable fastener at the top and providing a structure wherein forces that tend to pull the bag open from inside the bag are applied to the rib and groove fastener in a shear mode rather than a peel mode so that the fastener resists accidental opening.

FEATURES OF THE INVENTION

In accordance with the principles of the invention, a bag structure is provided wherein the bag is formed of a thin strong plastic film or of laminations of thin materials to provide front and back wall panels attached along their edges and along their bottom. The upper edges of the bag are separated to form an opening for filling the bag and for access to the bag for reusing it. In order to obtain the optimum features of plastic for the side wall such as thinness and toughness, and to obtain optimum features for the closure which requires a certain amount of rigidity to the plastic so that it is strong with minimum size and weight, fastener strips are used which are separately fabricated and attached to the inner surfaces of the panels at the top. The fastener strips are formed with pressure reclosable releasable rib and groove profiles extending continuously along the facing surfaces. Each of the strips has a web portion which is utilized for securing the strip to the inner face of the bag wall. The web portion of a first of the strips is structured so as to be attached to said strip along its lower edge below the center line of the fastener strip rib and groove profiles, that is, below the center line of the reclosable rib and groove elements. Preferably, the web element is attached along the very base of the first strip.

The other strip is also provided with a web element, but this web element is attached above the center line of the rib and groove element and preferably along the very top of the strip, being attached along its lower edge. The web elements are then bonded in full surface bonding to the inner surfaces of the wall panels.

When the wall panels are pushed apart due to the contents within the bags, such as occurs when the bags are tossed about or roughly handled, or over-filled, the wall panels spread and attempt to pull the fastener strips apart. In the present structure, the attachment of the web elements is such that the fastener strips will pivot and the stress on the fastener strips will be in a shear mode rather than a peel mode so that the strips resist separating. There is a double pivotal effect which results from the unique attachment between the web element for the first strip and the side wall in that there is a pivotal relationship between the web and the strip and also a pivotal relationship between the web element and the bag wall panel because the web element is attached to the wall panel only at its upper portion.

Other objectives, advantages and features will become more apparent with the teaching of the principles of the invention in connection with the disclosure of the preferred embodiments thereof in the specification, claims and drawings, in which:

DESCRIPTION OF THE PREFERRED EMBODIMENT

Figure 1:
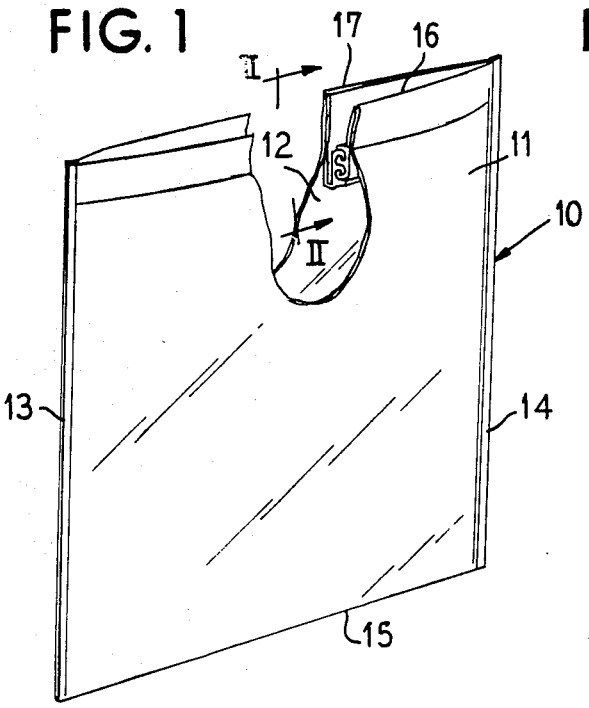
FIG. 1 is a perspective view of a bag, with a portion broken away at the top, constructed in accordance with the principles of the present invention.

FIG. 1 illustrates a plastic bag 10 formed of a thin material such as a polyethylene film several thousandths of an inch thick having characteristics of being a tough material but sufficiently lightweight with the film having a thickness only sufficient to withstand the stress of the contents to be filled into the bag. The bag is formed of a front flat panel 11 and a rear panel 12 and the panels are attached at their side edges 13 and 14 and attached at their base 15 to form a bag which is open at the top edge so that the edges 16 and 17 are separated for access to the bag.

Figure 2:
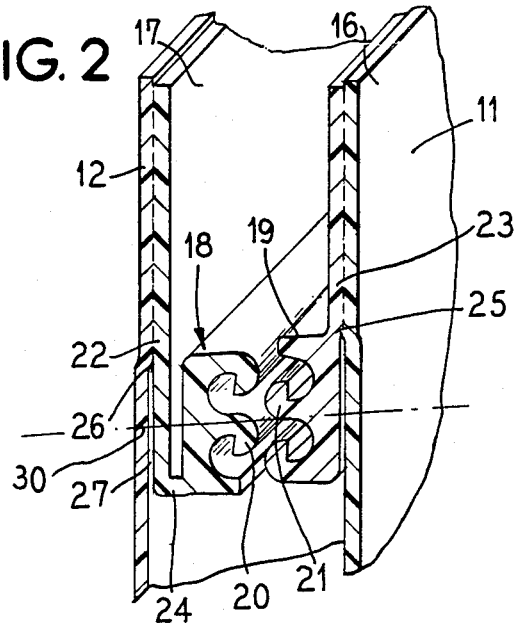
FIG. 2 is a vertical sectional view taken substantially along line II—II of FIG. 1 and illustrating the relationship of the parts of the top closure in somewhat enlarged detail with the section shown in perspective view.
Figure 3:
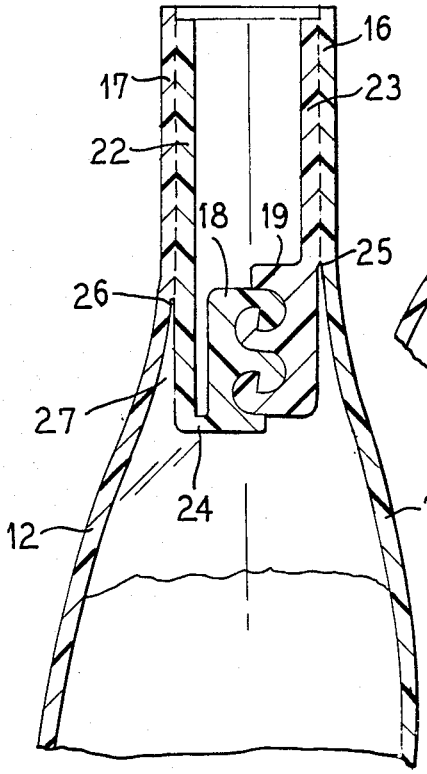
FIG. 3 is a sectional view taken substantially along line II—II, similar to FIG. 2, but showing the relationship of the closure parts in elevation and illustrating the effect of contents within the bag on the bag walls.

Secured at the bag top opening to provide a reopenable closure, are closure strips 18 and 19 (FIG. 2). These closure strips are constructed so as to have pressure closable continuous rib and groove elements 20 and 21 along confronting faces. This type of closure is joined by applying a joining pressure along the fastener so as to interlock the rib and groove elements, and is opened by pulling apart manually on pull flanges 16 and 17 extending upwardly at the top of the bag.

In the present arrangement, web elements 22 and 23 are provided for attaching the fastener strips 18 and 19 to the inner surfaces of the wall panels at the bag top.

For the first strip 18, the web element 22 is attached thereto only at its bottom edge at 24 along the base of the first strip. In the preferred arrangement, the web 22 is attached along the base of the strip, but it will be understood that it may be attached at any location to the strip as long as it is below the center line of the interlocking rib and groove elements 20 and 21 so that when the web tends to be pulled outwardly from the interlocked strips, the strips will tend to pivot or tilt about their center line.

The web 22 extends upwardly from its point of attachment and its upper surface is bonded to the inner surface of the wall panel 12. The face-to-face bond which is formed can be formed by a heat seal or by adhesive. However, it is significant that the bonding extends downwardly to location 26 which is located at or above the top edge of the fastener strip 18. With this arrangement as the bag walls 11 and 12 are pulled outwardly, as illustrated best in FIG. 4, a pivotal action occurs between the wall panel 12 and the web element 22 causing them to pivot relatively at 26 and contribute to the tilting or pivotal action of the joined strips 18 and 19 so that they tend to be acted on in shear mode rather than a peel mode. By shear mode it is meant a pull which extends parallel to their confronting faces and causes them to remain locked. By a peel mode, it is meant forces which pull at right angles to the plane of their confronting faces and which tends to pull them apart.

The second strip 19 is provided with a web element 23 for securing the strip to the wall panel 11. The web element 23 is attached along its lower edge to the uppermost edge of the strip 19.

The web 23 is bonded in face-to-face relationship with the inner surface of the top of the panel 11. The bonding extends down only to the base of the web at point 25 so that stresses which force the wall panel 11 outwardly will not act directly on the strip 19 but will cause the wall panel to pivot relative to the web element 23 at point 25. The effect of this structural relationship is shown further in FIG. 4 when the wall panel 11 is pushed outwardly by the bag contents. This action will result in the fastener strips pivoting or rotating about their longitudinal center line so that maximum pulling occurring on the strips as the walls 11 and 12 are pushed even further outwardly, will cause the strips to pull against each other in a direction parallel to their interlocking faces. That is, they will tend to be pulled apart acting on each other in a shear relationship rather than a peel relationship. Their strength against separation in a shear relationship is many-fold the resistance to separating in a peel relationship.

A secondary advantage to the structure of the webs at 22 and 23, and their attachment to the upper edges of the panel is that they are of sufficient vertical length so that they extend almost to the top edge of the bag. The webs 22 and 23 thus strengthen the thin plastic film at its upper edge to provide monolithic pull flanges.

When the bag is to be opened manually from the outside, the user grips the top edges of the bag and pulls them apart. This applies a concentration of stress at the place where the thumb and forefinger are used to grasp the top pull flanges and with very lightweight film for the bag walls 11 and 12, this pulling could tend to distort the plastic. However, with the pull flanges being of double layers, strength and rigidity are afforded to resist distortion and to aid in the opening. Actually, the double weight on the pull flanges better transmits the pulling force along the length of the strips to open them more easily and more uniformly. That is, the strips open relatively easily from lateral pulls on the pull flanges, since a peel force is being applied as compared to the forces acting on the bag walls 11 and 12 from the contents, where a shear force is being applied.

While the web elements 22 and 23 are of sufficient length to extend up to functionally act as part of the pull flanges, they are of a length to be just short of the top edge of the wall panels. This provides a somewhat feathered edge which becomes more easy to grab for the opener than if the webs extended either to the full height of the side wall panels or above the top edge of the side wall panels. It will be apparent that in gripping the pull flanges, the operator has to pry them apart sufficiently for him to insert his thumb or forefinger, and the projection of the side panels slightly above the web portions 22 and 23 aids in helping the user separate the pull flanges for gripping them.

Figure 4:
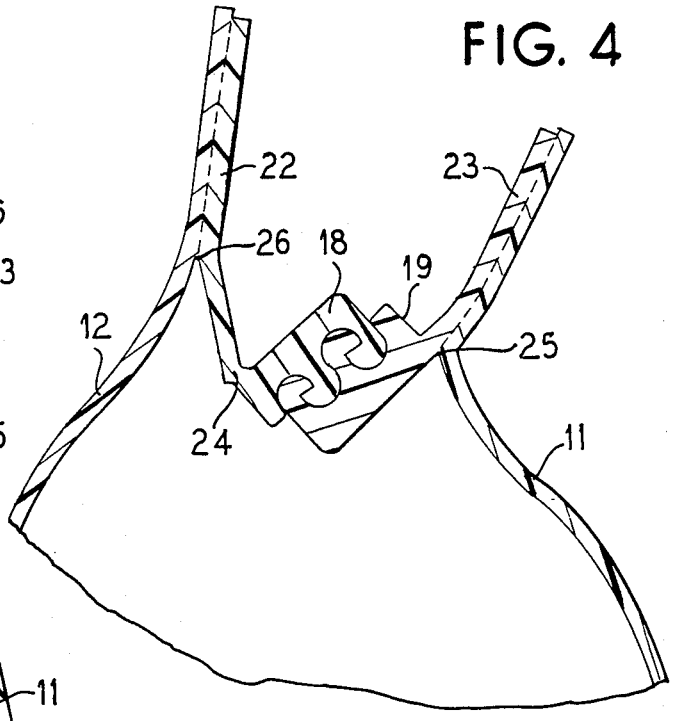
FIG. 4 is a fragmentary vertical sectional view, similar to FIG. 3 and illustrating the full effect of spreading forces on the wall panels as they act on the fastener and as it resists opening.

In operation, forces from the contents within the bag tend to push apart the wall panels in the manner shown in FIG. 4 particularly if the bags are over-filled or tossed about or roughly handled. These separation stresses which push the wall panels 11 and 12 outwardly, and which tend to pull the fastener strips 18 and 19 apart, are such in the present structure that opening is resisted due to the fact that the strip 19 pivots about point 25, and the strip 18 pivots about point 24 where the web portion is attached and pivots about point 26 where the web portion is attached to the wall panel. These tend to cause the strips 18 and 19 to pivot to align themselves in line with the forces tending to pull them apart so that they resist separation. Yet, the arrangement does not detract from the effectiveness in securing the top of the bag in normal operation. The web portions 22 and 23 which extend above the fasteners provide laminated strengtheners to the pull flanges and permit the formation of a bag with very lightweight plastic wall panels but which has strong and easily grippable pull flanges at the top. Both of the pivot points 25 and 26 are located above a line 30 (FIG. 2) which passes through the general center of the rib and groove fastener. Pivot point 24 is below the line 30. This combination of locations coacts to cause pivotal movement of the joined profiles when the bag walls are pushed outwardly.

Thus, it will be seen that we have provided a structure which meets the objectives and advantages above set forth and which provides a bag of maximum strength closure without requiring additional unnecessary plastic to substantially increase the cost of the bag.

I claim as my invention:

1. A reclosable bag structure comprising in combination:

front and back flexible plastic film wall panels attached along their bottom and, side edges and separated at their top edges to form a bag with a top filling opening;

and separate first and second complementary pressure closable and reopenable closure strips having interlocking profiles in confronting relationship within said top opening and each strip attached to the inner surface of a wall panel;

the first strip having a web portion attached at its base from a location below the center line of the interlocking profiles, with said web portion extending upwardly therefrom;

the second strip having a web portion attached at its base from above the center line of the interlocking profiles, with said web portion extending upwardly therefrom;

said web portions being surface bonded to the inner surfaces of the front and back panels respectively so that forces on the panels from internally of the bag will pivot the strips in a hinge action about their base so as to pull the closure strips with a shear action which resists separation of said strips.

2. A reclosable bag structure constructed in accordance with claim 1:

wherein the web portions extend upwardly above the strips a sufficient distance to provide manual pull flanges for separating the strips.

3. A reclosable bag structure constructed in accordance with claim 1:

wherein the webs are bonded to the panels with a heat bond.

4. A reclosable bag structure constructed in accordance with claim 1:

wherein the interlocking profiles are provided with plural ribs and grooves shaped to be pressure interlocking and to be separable with the application of peel forces.

5. A reclosable bag structure constructed in accordance with claim 1:

wherein the web portion of the second strip is hingedly connected to the strip at the top of said second strip.

6. A reclosable bag structure constructed in accordance with claim 1:

wherein the web portion of the first strip is hingedly connected to the strip at the lowermost point of said first strip.

7. A reclosable bag structure constructed in accordance with claim 1:

wherein said web portions and the top edges of the panels form multi-ply pull flanges above the strips.

8. A reclosable bag structure constructed in accordance with claim 7:

wherein the web portions extend upwardly a distance less than the height of the wall panels so that the top edges of the panels projects above the web portions.

9. A reclosable bag structure constructed in accordance with claim 7:

wherein the web portions are formed of a heavier material than the plastic film wall panels.

10. The method of making a reclosable bag structure comprising the steps:

providing front and back flexible plastic film wall panels attached along their bottom and side edges and separated at their top edges to form a top filling opening for a bag;

providing separate first and second complementary pressure closable reopenable closure strips and attaching the strips across the top of the bag to the inner surfaces of the wall panels;

said closure strips having interlocking rib and groove profiles on their confronting faces;

providing a web element for each of the strips for attaching the strips to the inner surfaces of the panels;

securing the web element for the first strip at a location below the center line of the interlocking profiles;

and securing the web element for the second strip at a location above said center line.

11. The method of making a reclosable bag structure in accordance with the steps of claim 10:

and heat bonding the outer surface of the web elements to the inner surface of the panels.

12. The method of making a reclosable bag structure in accordance with the steps of claim 10:

and bonding the surfaces of the web elements in an area bond to the inner surfaces of the wall panels.

13. The method of making a reclosable bag structure in accordance with the steps of claim 10:

and bonding the web elements to the inner surface of the wall panels at a location so that the web elements extend short of the top of the wall panels and the wall panels project above the top edges of the web elements.

14. The method of making a reclosable bag structure in accordance with the steps of claim 10:

wherein the web element for the first strip is attached at the extreme base edge of the first strip and the web element for the second strip is attached at the extreme top edge of the second strip.

15. A reclosable bag structure comprising in combination:

front and back flexible plastic film wall panels attached along their bottom and side edges and separated at their top edges to form a bag with a top filling opening;

and separate first and second complementary pressure closable and reopenable closure strips having interlocking profiles in confronting relationship within said top opening and each strip attached to the inner surface of a wall panel;

the first strip having a web portion attached at its base and extending upwardly from a location below the center line of the interlocking profiles;

means attaching the web portion of the first strip to the inner surface of the wall panel at the upper portion of the web portion so that the web portion and the wall panel can pivot away from each other at the lower area of attachment;

means attaching the second strip to the wall panel.

16. A reclosable bag structure constructed in accordance with claim 15:

wherein the second strip has a web portion attached at its base that extends upwardly from above the center line of the interlocking profiles.

17. A reclosable bag structure constructed in accordance with the claim 15:

wherein the web portion of the first strip is attached to the inner surface of the wall panel over an area extending only above the first fastener strip.

* * * * *